US007848674B2

(12) United States Patent
Takuwa

(10) Patent No.: US 7,848,674 B2
(45) Date of Patent: Dec. 7, 2010

(54) IMAGE FORMING APPARATUS

(75) Inventor: Noriyuki Takuwa, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 92 days.

(21) Appl. No.: 12/394,906

(22) Filed: Feb. 27, 2009

(65) Prior Publication Data

US 2009/0214247 A1 Aug. 27, 2009

Related U.S. Application Data

(60) Provisional application No. 61/032,038, filed on Feb. 27, 2008.

(51) Int. Cl.
*G03G 15/00* (2006.01)

(52) U.S. Cl. ..... 399/88; 399/90

(58) Field of Classification Search ..... 399/88–90; 307/52

See application file for complete search history.

(56) References Cited

U.S. PATENT DOCUMENTS 7,561,822 B2 * 7/2009 Watanabe et al. ..... 399/107
7,675,196 B2 * 3/2010 Kimura ..... 307/52

FOREIGN PATENT DOCUMENTS

| | | |
|---|---|---|
| JP | PH09-080989 | 3/1997 |
| JP | P2004-077674 | 3/2004 |
| JP | P2004-117812 | 4/2004 |

* cited by examiner

*Primary Examiner*—Hoang Ngo
(74) *Attorney, Agent, or Firm*—Patterson & Sheridan, LLP

(57) ABSTRACT

It is possible to provide a technique capable of attaching a reactor to a power source unit even upon shipping a package containing an image forming apparatus from a factory as well as opening the package and installing the image forming apparatus in a place for installment, by optionally attaching the reactor to the power source unit.

An image forming apparatus includes a case to accommodate a main body of the image forming apparatus and having a bottom portion; and a power source unit provided with at least an AC filter unit and a DC output circuit unit, and a reactor space disposed in the bottom portion of the case, the reactor space being a space for installing a reactor between the AC filter unit and the DC output circuit unit.

20 Claims, 6 Drawing Sheets

IMAGE FORMING APPARATUS

CROSS-REFERENCE TO RELATED APPLICATION

This application is based upon and claims the benefit of priority from: U.S. provisional application 61/032,038, filed on Feb. 27, 2008, the entire contents of each of which are incorporated herein by reference.

TECHNICAL FIELD

The present invention relates to power (harmonics, power factor) improvement of a power source unit for supplying power to devices configuring an image forming apparatus.

BACKGROUND

Conventionally, in image forming apparatus such as a copier, a printer and the like, power is supplied to a variety of devices such as a fixer, an image exposure device which uses a laser beam, charger and discharger, an image bearer belt, and a driving motor of an image bearer body such as a photoconductive drum, etc., from a power source unit.

The power source unit typically includes an AC filter unit and an insulated DC output circuit unit. Power is inputted to the AC filter of the power source unit from an external AC power source which is a commercial power source. The AC filter unit and the DC output circuit unit are coupled to each other via an electrical wiring. By such a configuration, the power source unit supplies DC power to various devices.

In the power source unit, a power source unit of one type generally is applied to several models; however, a main body of the image forming apparatus recently requires much power due to increasing of a copy speed (the number of print per unit time), colorization, energy consumption save such as a sleep mode and the like.

Thereby, measures such as lowering of a copy speed and a temporary stop of copying operation are proposed when power is not sufficiently supplied to the image forming apparatus, but the image forming apparatus cannot show a complete performance by such measures.

Meanwhile, it is known to prevent power shortage in the power source unit by improving harmonics (harmonic interference occurring in electrical wirings) of AC filter unit and a power factor, and, a reactor is used for this.

However, since power can sufficiently and stably be supplied depending on models of the image forming apparatus although the power source unit is not provided with the reactor having a weight, the reactor is optionally provided to the power source unit of models requiring it, which can reduce cost and make the image forming apparatus light-weighted.

In addition, if shipping the image forming apparatus in a state of the weighted reactor being attached to the AC filter unit or the DC output circuit unit, a frame of the apparatus main body equipped with the reactor is in danger of being influenced by transporting a package containing the image forming apparatus, opening the package and carrying the image forming apparatus to a place for installment and so forth at the time of shipping from a factory.

Further, the reactor emits heat and thus needs to be cooled, however, providing a cooling device dedicated to the reactor causes increase of cost and weight as well as requires a margin for displacement space of the cooling device to make it difficult to layout the members configuring the power source unit.

SUMMARY

An object of the present invention is to provide a technique capable of attaching a reactor to a power source unit even upon shipping a package containing an image forming apparatus from a factory as well as opening the package and installing the image forming apparatus in a place for installment, by optionally attaching the reactor to the power source unit.

In order to accomplish the object, one aspect of the present invention relates to an image forming apparatus including a case to accommodate a main body of the image forming apparatus and having a bottom portion; and a power source unit provided with at least an AC filter unit and a DC output circuit unit, and a reactor space disposed in the bottom portion of the case, the reactor space being a space for installing a reactor between the AC filter unit and the DC output circuit unit.

DETAILED DESCRIPTION

Hereinafter, embodiments of the present invention will be described with reference to the accompanying drawings.

First Embodiment

A first embodiment according to the present invention will now be described.

Figure 1:
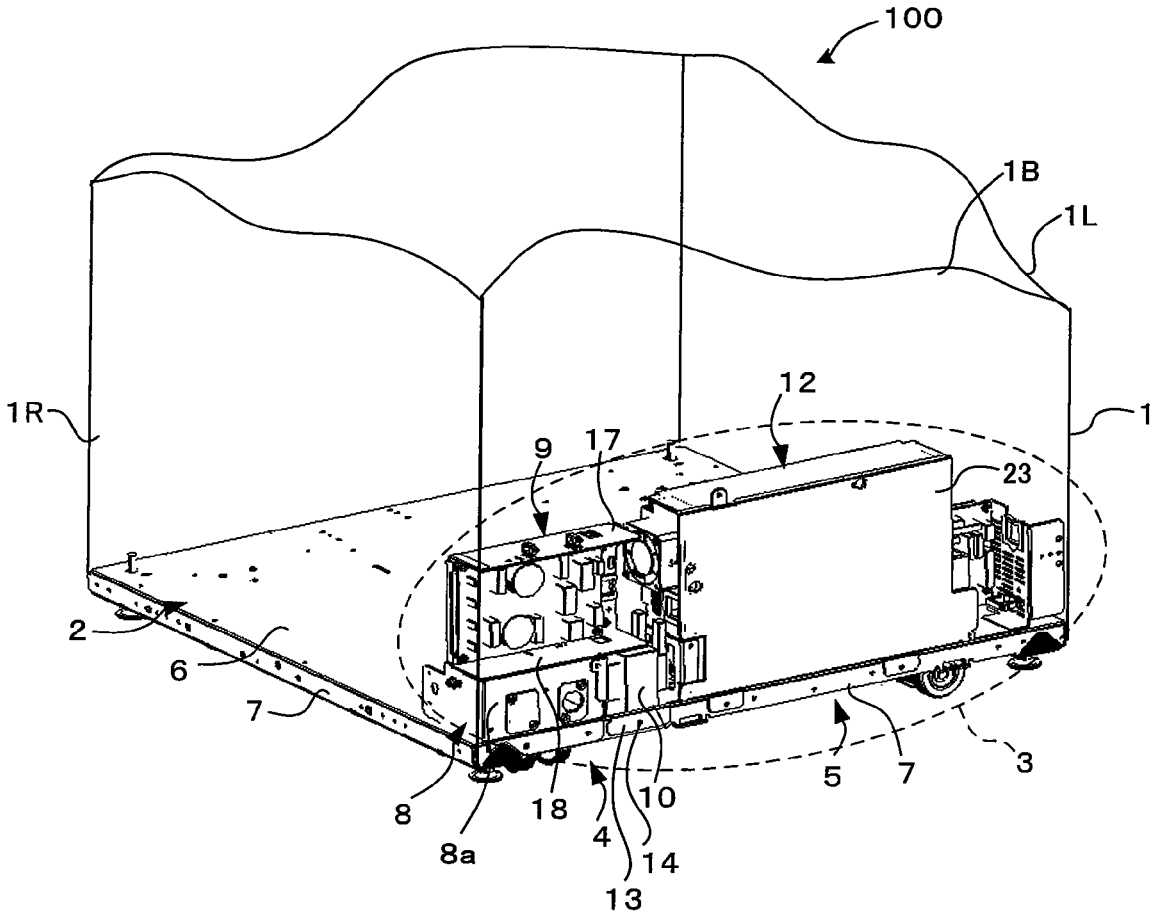
FIG. 1 is a perspective view to illustrate an example of a power source unit of an image forming apparatus according to a first embodiment of the present invention.

FIG. 1 is a perspective view to illustrate an example of a power source unit of an image forming apparatus according to the first embodiment of the present invention.

In an image forming apparatus 100 shown in FIG. 1, a power source unit 3 is disposed on a bottom portion 2 configuring a case 1 of a main body of the apparatus. The power source unit 3 is disposed at the rear of the case 1 along the edge of the bottom portion 2 in the image forming apparatus 100.

The case 1 also contains a paper supply unit (not shown) which loads papers of multiple sizes, the papers being output media and recording material as a main constituent element of the image forming apparatus, and supplies a paper of selected size to a position where an image is transcribed, an image bearer body (not shown) as a photoconductive drum or an image bearer belt to form electrostatic latent images by use of image exposure light, and a fixer (not shown) which heats and compresses the paper into which a toner image on the image bearer body is transcribed at the transcribed position to fix the toner image to the paper.

The power source unit 3 includes at least an AC filter unit 4 of a unit structure for removing noises of AC power and an insulated DC output circuit unit 5 of a unit structure for converting the AC power into DC power, as a basic configuration. In the power source unit 3, the AC filter unit 4 and the DC output circuit unit 5 are disposed along the edge of the bottom portion 2 in a transverse direction (left and right direction from a front view of the main body of the apparatus) in the vicinity of the rear side of the case 1. The bottom portion 2 has a robust configuration where a frame member 7 is fixed to at least four edges of a quadrangle bottom 6, and the AC filter unit 4 and the DC output circuit unit 5 are mounted on the frame member 7.

Figure 2:
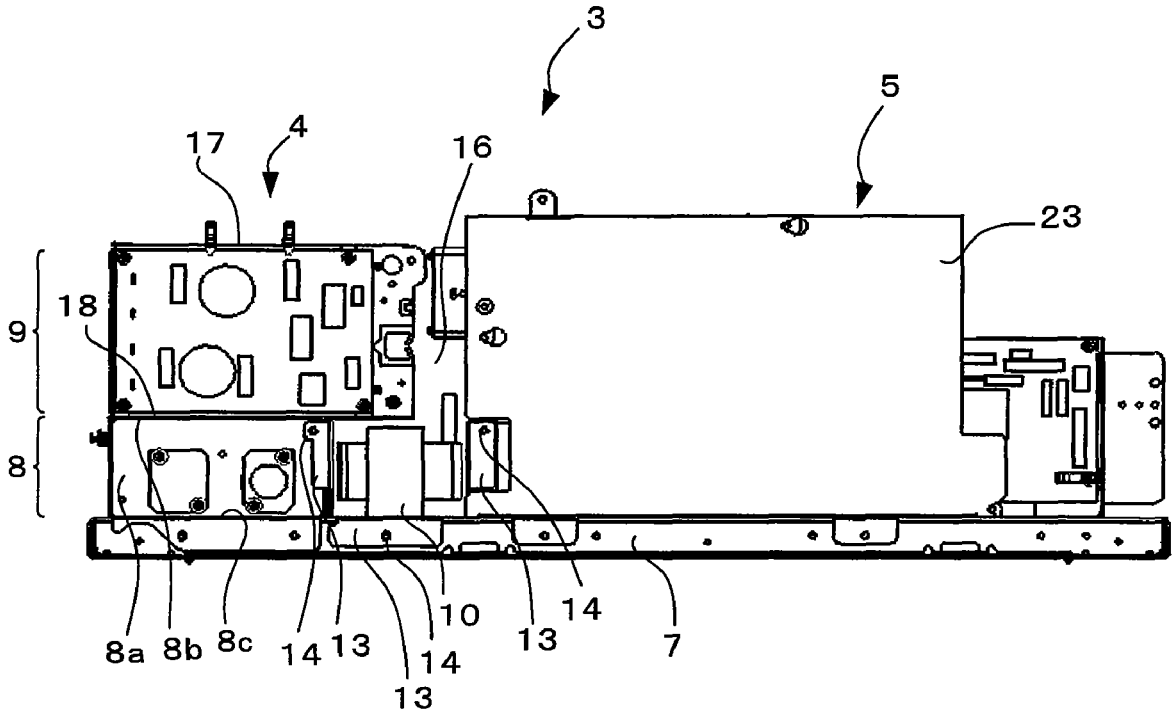
FIG. 2 is a front view of the power source unit in a state of attaching a reactor of FIG. 1.
Figure 3:
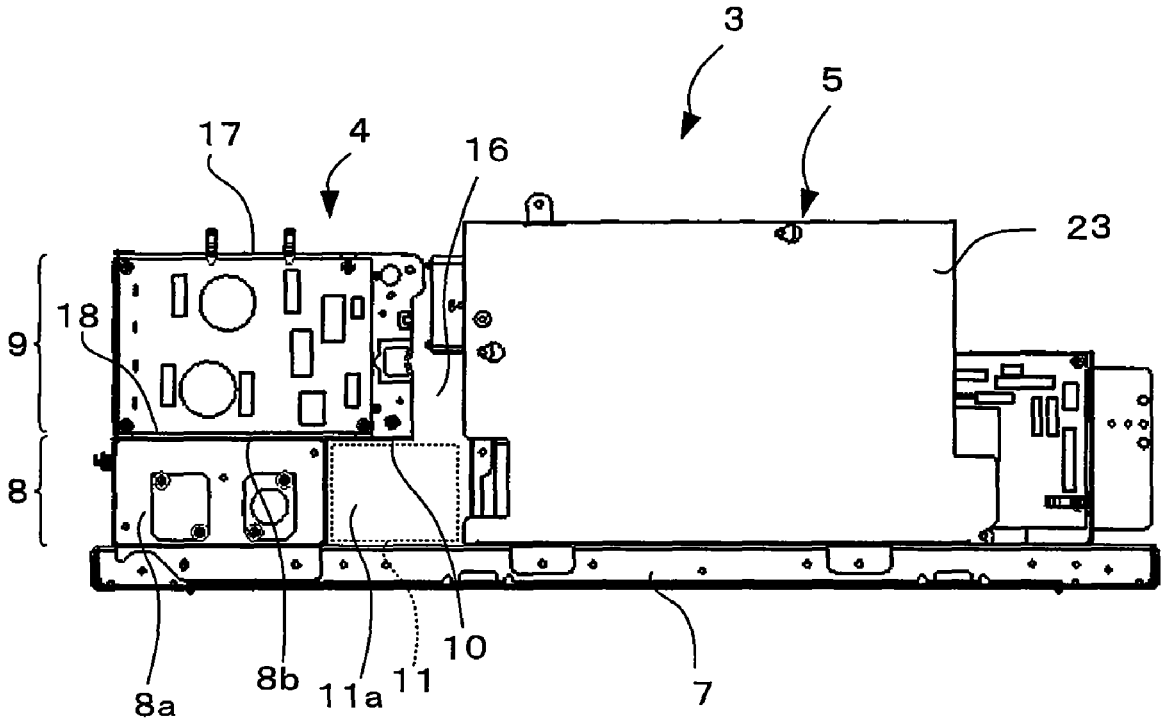
FIG. 3 is a front view of the power source unit in a state of not attaching a reactor of FIG. 1.

The AC filter unit 4 has a dual layered structure of upper and lower having a first chassis 8 provided with a plurality of electronic components, and a second chassis 9 provided with a plurality of electronic components, attached on the first chassis 8, as schematically shown in FIGS. 2 and 3. One end of the second chassis 9 extends toward the DC output circuit unit 5 more than the first chassis 8 and a reactor space 11 for installing the reactor 10 is provided directly under the extending portion.

In addition, the first chassis 8 has a longitudinal plate 8*a*, an upper plate 8*b* and a lower plate 8*c* protruding in order to bend orthogonally to each of the upper end and the lower end of the longitudinal plate 8*a*. In the first chassis 8, the longitudinal plate 8*a* is disposed in order to face a rear panel 1B which is a side panel of the case 1, and an air path is disposed inside (a side where the upper plate 8*b* and the lower plate 8*b* protrude) of the longitudinal plate 8*a*.

If separating the rear panel 1B of the case 1 therefrom, the power source unit 3 appears, and, as shown in FIGS. 2 and 3, the reactor 10 is attached to the frame member 7, the first chassis 8 adjacent thereto and a third chassis 12 (described in detail later) configuring the DC output circuit unit 5, using a screw 14, in the reactor space 11. In detail, the reactor 10 is fixed by fastening a flange 13 formed as one body with the reactor 10 to the first chassis 8, the third chassis 12 and the frame member 7 using the screw 14.

In the present embodiment, when the reactor 10 is required, the AC filter unit 4, the reactor 10 and the DC output circuit unit 5 are disposed such that the reactor 10 is attached between the AC filter unit 4 and the DC output circuit unit 5 of which ends approximate to each other and thus become parallel to a wiring path of reaching the DC output circuit unit 5 from the AC filter unit 4 through the reactor 10. This can optimize a wiring by shortening a connection wiring and prevent reduction of a power factor due to a wiring.

Figure 4:
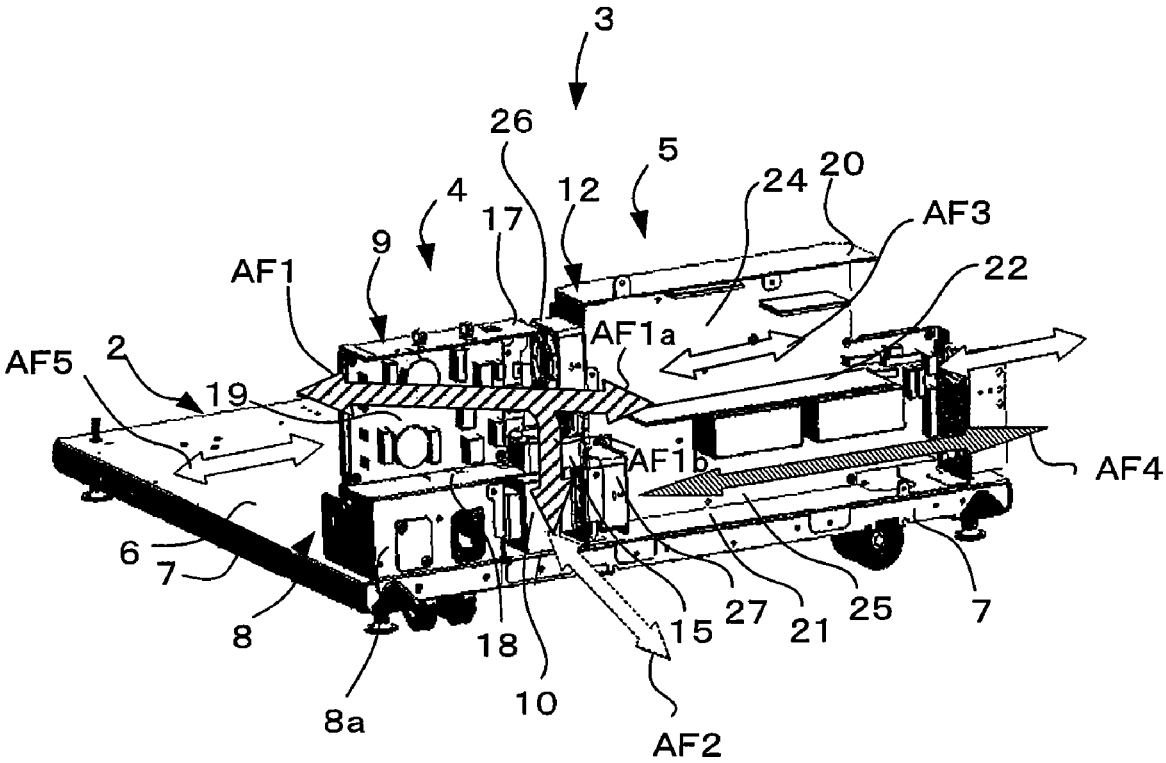
FIG. 4 is a perspective view to illustrate a state of disposing an air-cooling fan 15 for the reactor at a space 16 for the air-cooling fan.

The reactor 10 is a coil component, which self-emits heat, so it needs to be cooled. Thus, the power source unit 3 is provided with an air-cooling fan space 16 for attaching an air-cooling fan 15 for reactor, the space 16 being positioned in the left-end portion of the second chassis 9 above the reactor space 11 for disposing the reactor 10, as shown in FIGS. 2 and 3. If the reactor 10 cannot be sufficiently cooled by an air cooling of the power source unit 3 in the image forming apparatus in which the reactor 10 is attached in the reactor space 11, the air-cooling fan 15 for reactor is attached in the air-cooling fan space 16 to generate an upward and downward air flow (AF 1*b* described later in FIG. 4) for cooling the reactor 10 at lower side by sending the air. Of course, the air-cooling fan 15 for reactor can reversely rotate to adjust a temperature of the reactor 10 by an air introduced from the DC output circuit unit, if necessary. FIG. 4 is a perspective view to illustrate a state of installing the air-cooling fan 15 for reactor in the air-cooling fan space 16.

The image forming apparatus may be shipped from a factory in a state of installing the reactor 10 in the reactor space 11, or otherwise, the reactor 10 alone or the reactor 10 and the air-cooling fan 15 for reactor may be attached therein after separating the rear panel 1B of the case 1 in a place for installing the image forming apparatus.

Since the reactor 10 is disposed on the frame member 7, and although the weighted reactor 10 is shipped from a factory in a state of being attached in the reactor space 11, (1) transporting a package containing the image forming apparatus, (2) opening the package and (3) carrying the unpacked image forming apparatus to a place for installment and the like have little influence on the frame member 7 and the like. Further, according to the configuration of the present embodiment, influence on the bottom portion 2 of the case 1 can be minimized by attaching the reactor 10 in the reactor space 11 at the time of opening the package or installing the image forming apparatus in a place for installment.

The second chassis 9 is provided with an air path 19 for generating an air flow AF1*a* along the transverse direction of the apparatus main body by an upper plate 17 and the lower plate 18 extending toward the rear panel 1B and between the upper plate 17 and the lower panel 18, the air path extending to the air-cooling fan space 16, as schematically shown in FIG. 4.

In addition, if possible considering a configuration of the apparatus, an airing portion may be provided in the rear panel 1B in correspondence to the reactor space 11 to form an air path 11*a* for generating an air flow AF2 in front and rear direction with respect to the main body of the apparatus. Thereby, it is of course to cool the reactor 10 attached in the reactor space 11 by exhausting the air flows out of the apparatus and intaking an outer air into the apparatus.

As schematically shown in FIG. 4, the DC output circuit unit 5 has the third chassis 12 configuring a chassis of the DC output circuit unit 5. The third chassis 12 has a configuration of providing a middle plate 22 between an upper plate 20 and a lower plate 21. The upper plate 20, the lower plate 21 and the middle plate 22 protrude in order to orthogonally bend toward the rear panel of the case 1.

The rear side of the third chassis 12 is closed by the rear panel 23 (see FIG. 1) to form a space, and an upper air path 24 for generating an air flow AF3 in a transverse direction with respect to the main body of the apparatus between the middle plate 22 and the upper plate 20 and a lower air path 25 for generating an air flow AF4 in a transverse direction with respect to the main body of the apparatus between the middle plate 22 and the lower plate 21 are formed at upper and lower parts.

An upper air-cooling fan 26 is attached to the outside of the third chassis 12 to generate an air flow AF3 in the right direction (intaking the outer cold air into the apparatus) or in the left direction (exhausting the air out of the apparatus) inside the upper air path 24, in the right end of the upper air path 24 (AC filter unit 4 side), and at the same time to generate an air flow AF1*a*. A lower air-cooling fan 27 is attached to the inside of the third chassis 12 to generate an air flow AF4 in the right direction (intaking the outer cold air into the apparatus) or in the left direction (exhausting the air out of the apparatus) inside the lower air path 25, in the right end of the lower air path 25 (reactor space 11 side). As such, an air sends to the reactor 10 attached in the reactor space 11 for cooling, by generating the respective air flows.

Furthermore, when the reactor 10 is sufficiently cooled by the upper and the lower air-cooling fans 26 and 27 although the air-cooling fan 15 for reactor is not attached, a wind flow is generated efficiently without a dedicated air-cooling fan, thereby increasing a cooling effect of the reactor 10.

The case 1 intakes the outer air into the main body of the apparatus and exhausts the air out of the main body of the apparatus through air entrances (not shown) formed in a left panel 1L and a right panel 1R. In addition, an airing hole (not shown) formed on the right panel 1R of the case 1 generates an air flow AF5 for exhausting and intaking an air in a transverse direction.

Second Embodiment

Subsequently, a second embodiment of the present invention will now be described.

The second embodiment of the present invention is a modification of the first embodiment described above. Hereinafter, in the present embodiment, elements having the same functions as those described in the first embodiment are given the same reference numerals and the description thereof will be omitted.

Figure 5:
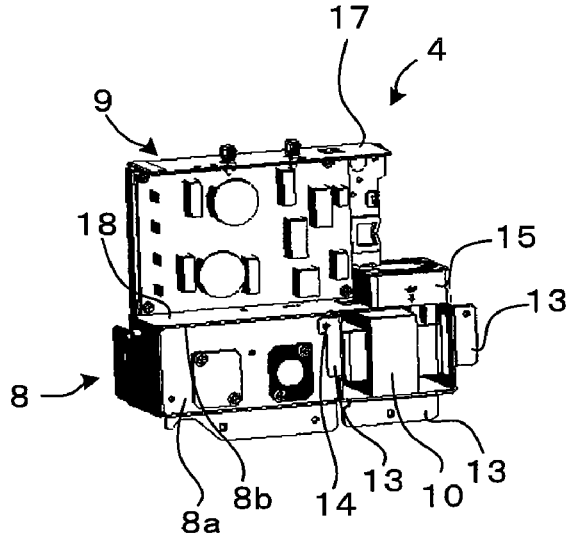
FIG. 5 is an exploded perspective view to illustrate an image forming apparatus according to a second embodiment of the present invention.

FIG. 5 is an exploded perspective view to illustrate an image forming apparatus according to the second embodiment of the invention.

The reactor 10 of the present embodiment is installed in the first chassis 8 of the AC filter unit 4 of the power source unit 3 in advance such that it is detachable through the attaching flange 13 by the screw 14, as schematically shown in FIG. 5.

That is, the reactor 10 configures a portion of the AC filter unit 4 as a single unit.

Third Embodiment

A third embodiment of the present invention will now be described.

The third embodiment of the present invention is a modification of each of the embodiments described above. Hereinafter, in the present embodiment, elements having the same functions as those above-described in each of the embodiments are given the same reference numerals and the description thereof will be omitted.

Figure 6:
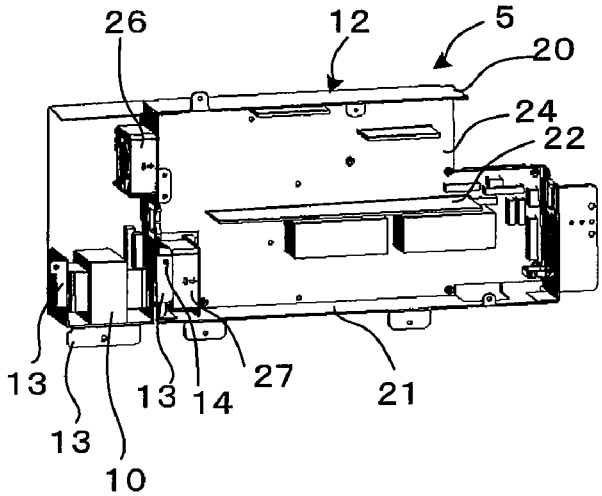
FIG. 6 is an exploded perspective view to illustrate an image forming apparatus according to a third embodiment of the present invention.

FIG. 6 is an exploded perspective view to illustrate an image forming apparatus according to the third embodiment of the invention.

The reactor 10 of the present embodiment is installed in the third chassis 12 of the DC output circuit unit 5 of the power source unit 3 in advance such that it is detachable through the attaching flange 13 by the screw 14, as shown in FIG. 6.

That is, the reactor 10 configures a portion of the DC output circuit unit 5 as a single unit.

Although the reactor 10 configures a portion of the AC filter unit 4 or the DC output circuit unit 5 as a single unit, the reactor 10 is attached to the frame member 7 through the attaching flange 13 by the screw 14, as shown in FIGS. 1, 2 and 4. In addition, the attached reactor 10 can be independently detached from the frame member 7 of the bottom portion 2, the AC filter unit 4 and the DC output circuit unit 5 the same as the image forming apparatus shown in FIG. 1. Further, when the reactor 10 is attached to the AC filter unit 4 in advance, the air-cooling fan 15 may be attached to the AC filter unit 4 in advance, if necessary.

Fourth Embodiment

A fourth embodiment of the present invention will now be described.

The fourth embodiment of the present invention is a modification of each of the embodiments described above. Hereinafter, in the present embodiment, elements having the same functions as those above-described in each of the embodiments are given the same reference numerals and the description thereof will be omitted.

Figure 7:
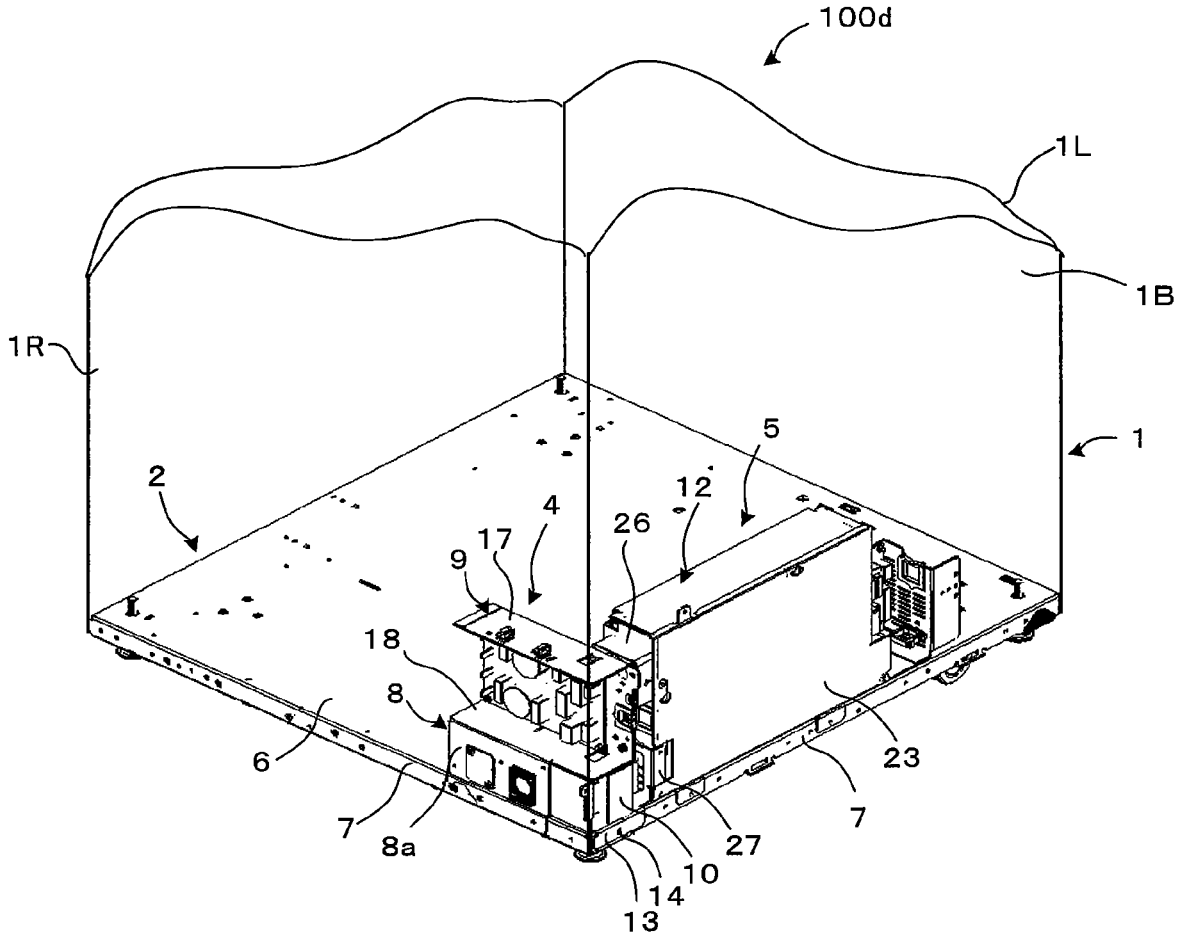
FIG. 7 is an exploded perspective view to illustrate an image forming apparatus according to a fourth embodiment of the present invention.

FIG. 7 is an exploded perspective view to illustrate an image forming apparatus according to the fourth embodiment of the invention.

In an image forming apparatus 100*d* shown in FIG. 7, the AC filter unit 4 and the DC output circuit unit 5 are not arranged in a line in a transverse direction at the rear side of the bottom portion 2 of the case 1 like the image forming apparatus shown in FIG. 1, but the AC filter unit 4 and the DC output circuit unit 5 are arranged in a character "L" shape at the far right corner of the bottom portion 2.

The AC filter unit 4 is disposed along the right panel 1R in the vicinity of the rear side of the apparatus on the bottom portion 2 of the case 1 in the present embodiment. In addition, the DC output circuit unit 5 is disposed in the vicinity of the rear side of the apparatus on the bottom portion 2 such that it approaches the inside end portion of the AC filter unit 4 as close as possible, in the present embodiment.

The reactor space 11 is formed in the inside end portion of the AC filter unit 4 in order to face both of the rear side 1B and the right side 1R of the case 1. The reactor 10 is attached to the frame member 7 in the reactor space 11 through the attaching flange 13 by the screw 14, if necessary.

The right end portion of the third chassis 12 is disposed approximately to the reactor 10 in the DC output circuit unit 5. Since the lower air-cooling fan 27 is disposed inside the right end of the third chassis 12 (see FIG. 4), the reactor 10 can be cooled by the lower air-cooling fan 27. Further, since the reactor 10 faces the rear panel 1B and the right panel 1R of the case 1, heat generated from the reactor 10 can be emitted outwardly via the rear panel 1B and the right panel 1R.

The reactor 10 is mounted on the fixed frame member 7 in each of the rear end and the right end of the bottom 6 and thus a load of the reactor 10 which the bottom 6 receives can be dispersed for support. Further, the AC filter unit 4 and the DC output circuit unit 5 are mounted on the respective frame members 7 and thus a load of the AC filter unit 4 and the DC output circuit unit 5 which the bottom 6 receives can be dispersed for support.

As described above, according to the embodiments of the present invention, when a power source unit having a configuration of not being equipped with a reactor is taken as a standard, the reactor can be optionally attached to the power source unit independently, thereby providing an image forming apparatus capable of detaching the installed reactor.

In addition, power source units of image forming apparatuses of plural kinds are standardized to employ a power source unit of one kind, and the reactor is optionally attachable in case of being in danger of power shortage; thus the number of components required for assembling the power source unit of the image forming apparatus can be decreased.

When the reactor is installed, a wiring among the AC filter unit, the reactor and the DC output circuit unit can be optimized to prevent lowering of a power factor due to a wiring, thereby preventing power shortage. Thus, it is possible to provide an image forming apparatus capable of stably supplying power.

Since the reactor is independently attachable, the reactor is attached upon shipping a package containing an image forming apparatus from a factory as well as opening the package and installing the image forming apparatus in a place for installment; thus it is possible to provide an image forming apparatus capable of minimizing influence on the bottom portion of the case upon transporting the package, opening the package and thereafter carrying the image forming apparatus to a place for installment.

In addition, according to the respective embodiments described above, the attached reactor can be cooled using the air-cooling mechanisms of the AC filter unit and the DC output circuit unit and a dedicated air-cooling fan can be attached depending on an equipment of the reactor; thus it is possible to provide an image forming apparatus capable of efficiently cooling the reactor itself.

Although the description of the embodiments is made on the premise that the outline of the bottom 6 is almost quadrangle, the present invention is not limited thereto. In other words, it is needless to say that, when the outline of the bottom 6 has shapes other than quadrangle, the present invention is applicable to such shapes.

Further, although the above-described embodiments take an example of securing a disposition space with a substantially cube as the reactor space 11, the present invention is not limited thereto, but it has only to secure a space for attaching and detaching the reactor. Therefore, when the reactor has a shape other than the cube, the reactor space 11 is also required to be formed according to the shape of the reactor.

Various modifications and alterations of this invention will be apparent to those skilled in the art without departing from the scope and spirit of this invention, and it should be understood that this is not limited to the illustrative embodiments set forth herein. The scope of the invention is defined by the appended claims, and is not restricted by contents of the specification. All suitable modifications, improvements, alternations and reformings equivalent to the scopes of the claims fall within the scope thereof.

As described above in detail, according to the present invention, it is possible to provide a technique capable of attaching a reactor to a power source unit even upon shipping a package containing an image forming apparatus from a factory as well as opening the package and installing the image forming apparatus in a place for installment, by optionally attaching the reactor to the power source unit.

What is claimed is:

1. An image forming apparatus comprising:

a case to accommodate a main body of the image forming apparatus and having a bottom portion; and a power source unit provided with at least an AC filter unit and a DC output circuit unit, and a reactor space disposed in the bottom portion of the case, the reactor space being a space for installing a reactor between the AC filter unit and the DC output circuit unit.

2. The apparatus according to claim 1, wherein the AC filter unit and the DC output circuit unit are disposed on a frame member of the bottom portion at the rear side of the main body of the image forming apparatus, in a line in a transverse direction of the main body of the image forming apparatus.

3. The apparatus according to claim 1, wherein the reactor space is provided facing the rear side and the lateral side of the case.

4. The apparatus according to claim 3, wherein the DC output circuit unit is disposed at the rear side of the main body of the image forming apparatus on the frame member of the bottom portion in the transverse direction of the main body of the image forming apparatus, the AC filter unit is disposed at the lateral side of the main body of the image forming apparatus on the frame member of the bottom portion in front and rear direction of the main body of the image forming apparatus, one end portion of each of the AC filter unit and the DC output circuit unit faces each other, and the reactor space is provided in the facing portion.

5. The apparatus according to claim 1, wherein the AC filter unit has a configuration of providing an upper chassis on a lower chassis; and wherein one end of the upper chassis extends more than one end of the lower chassis, and the reactor space is provided under the extending portion of the upper chassis.

6. The apparatus according to claim 1, wherein the reactor is attachable or detachable in or from the reactor space in the rear side of the case.

7. The apparatus according to claim 6, wherein the reactor is fixed to a rear frame member of the bottom portion, a chassis configuring the AC filter unit and another chassis configuring the DC output circuit unit through an attaching flange provided to the reactor by a screw, from the rear side of the case.

8. The apparatus according to claim 1, wherein the reactor is installed in the reactor space in order to be detachable with respect to a chassis of the AC filter unit or the DC output circuit unit.

9. The apparatus according to claim 1, wherein the AC filter unit and the DC output circuit unit have air paths for circulating air flows for the reactor space.

10. The apparatus according to claim 9, wherein the DC output circuit unit has upper and lower air paths of dual layers; and wherein the reactor space is provided in a place where the lower air path extends.

11. The apparatus according to claim 10, wherein a lower air-cooling fan facing the reactor space is provided in the lower air path.

12. The apparatus according to claim 11, wherein the lower air-cooling fan is provided in an inner side from an end of the DC output circuit unit.

13. The apparatus according to claim 10, wherein an upper air-cooling fan facing the upper reactor space is provided in the upper air path.

14. The apparatus according to claim 13, wherein the power source unit is provided with an air-cooling fan space for attaching an air-cooling fan for reactor which generates an air flow in a longitudinal direction, the air-cooling fan space being disposed on the upper reactor space.

15. The apparatus according to claim 10, wherein the upper and lower air paths of dual layers of the DC output circuit unit are formed by a chassis of the DC output circuit unit and a rear panel of the image forming apparatus.

16. The apparatus according to claim 13, wherein the upper air-cooling fan is provided in an outer side from an end of the DC output circuit unit.

17. The apparatus according to claim 1, further comprising an air path for guiding an air flow of an outer air to the reactor space, along a front and rear direction of the main body of the image forming apparatus.

18. The apparatus according to claim 9, wherein the air path of the DC output circuit unit causes the air to flow in a transverse direction of the main body of the image forming apparatus.

19. The apparatus according to claim 9, wherein the AC filter unit is provided with upper and lower chassis of dual layers; and wherein an air path formed in the upper chassis faces an upper side of the reactor space.

20. The apparatus according to claim 9, wherein in the AC filter unit, an upper plate and a lower plate extend from an upper end and a lower end of a longitudinal plate of the AC filter unit, a surface of the longitudinal plate of which the upper and the lower plates extend faces a side panel of the case, and an air path is formed in a side where the longitudinal plate faces the side panel.

* * * * *